United States Patent [19]

Healy

[11] 4,324,170

[45] Apr. 13, 1982

[54] RESIDUE-ACCOMMODATION MEANS FOR A GAS-OPERATED GUN

[75] Inventor: James J. Healy, Laguna Beach, Calif.

[73] Assignee: The United States of America as represented by the Secretary of the Army, Washington, D.C.

[21] Appl. No.: 108,446

[22] Filed: Dec. 31, 1979

[51] Int. Cl.[3] ..... F41D 5/12

[52] U.S. Cl. ..... 89/159; 89/193

[58] Field of Search ..... 89/159, 191 R, 193

[56] References Cited

U.S. PATENT DOCUMENTS

| | | | |
|---|---|---|---|
| 1,524,974 | 2/1925 | Hazelton | 89/193 |
| 2,149,512 | 3/1939 | Eiane | 89/193 |
| 2,186,582 | 1/1940 | Gebauer | 89/193 |

FOREIGN PATENT DOCUMENTS

| | | | |
|---|---|---|---|
| 252429 | 5/1926 | United Kingdom | 89/193 |

*Primary Examiner*—Stephen C. Bentley

*Attorney, Agent, or Firm*—Peter A. Taucher; John E. McRae; Nathan Edelberg

[57] ABSTRACT

A recoil-operated gun wherein combustion gases are bled from the gun barrel against an end surface of a bolt-operating piston that is slidably disposed in a stationary cylinder carried by the gun receiver. A system of radial grooves and annular pockets is provided in the confronting surfaces of the piston and cylinder to store residue associated with the combustion gases, thereby preventing frictional build-ups and premature wear or jamming due to residue accumulations in the sliding interfaces.

4 Claims, 7 Drawing Figures

RESIDUE-ACCOMMODATION MEANS FOR A GAS-OPERATED GUN

The invention described herein may be manufactured, used, and licensed by or for the Government for governmental purposes without payment to me of any royalty thereon.

BACKGROUND AND SUMMARY OF THE INVENTION

This invention relates to an improvement on the invention described in U.S. patent application, Ser. No. 909,741 filed in the name of Robert B. Crowell on May 25, 1978, now Pat. No. 4,178,832. The present invention is especially concerned with means for removing powder-like combustion residues from the sliding surfaces in the mechanism disclosed in the already-filed patent application. The powder-removing mechanism includes a system of radial grooves in the piston-cylinder end wall interface, and at least one annular pocket in the cylinder side surface. Reciprocal motion of the piston causes the residue particulates to collect in the annular pockets where they cannot prematurely wear the sliding surfaces or jam the components against normal movement.

THE DRAWINGS

Figure 1:
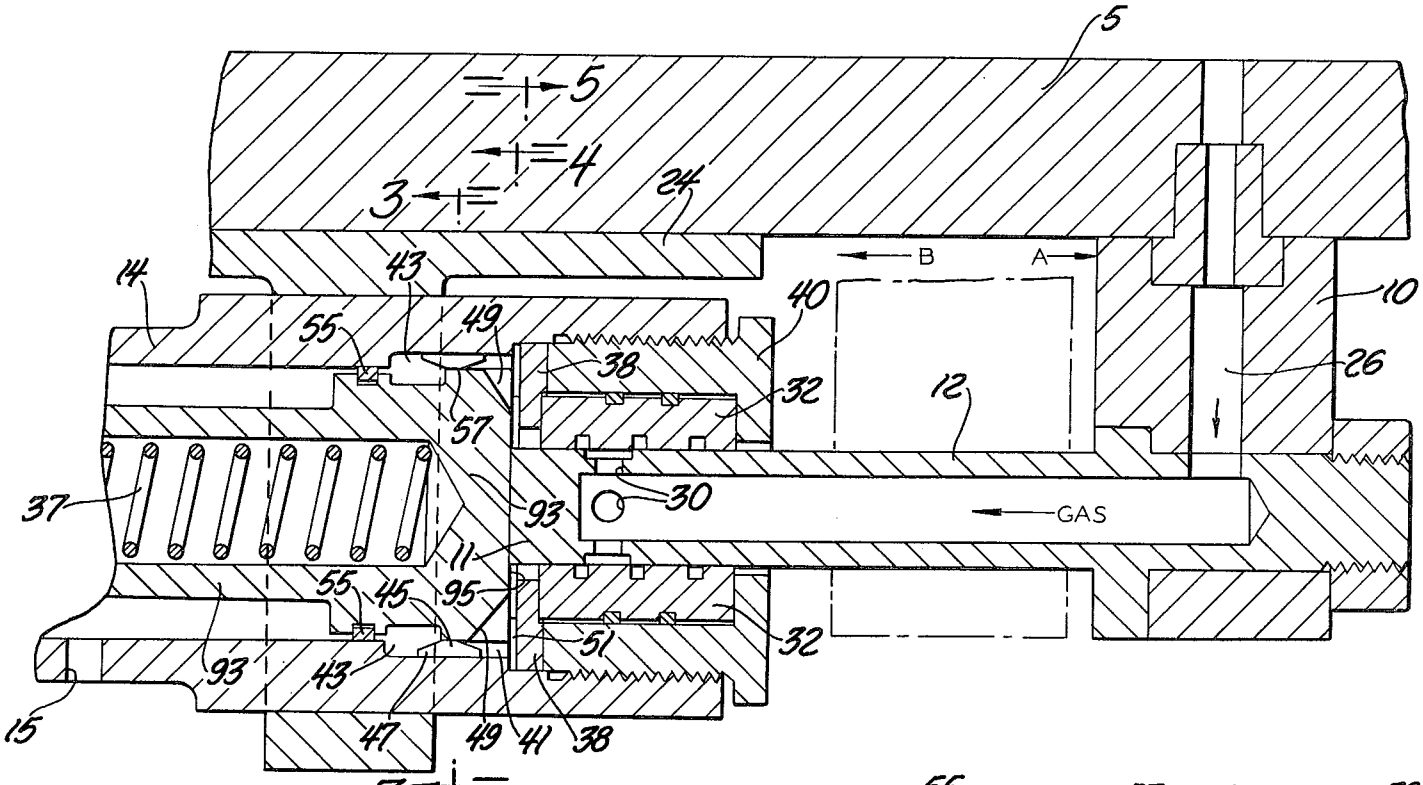
FIG. 1 is a fragmentary sectional view through a gun embodying my invention.
Figure 3:
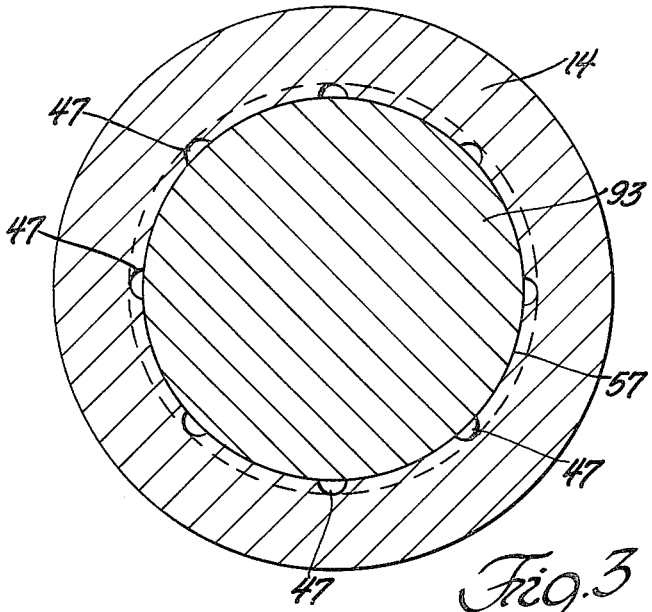
Figure 4:
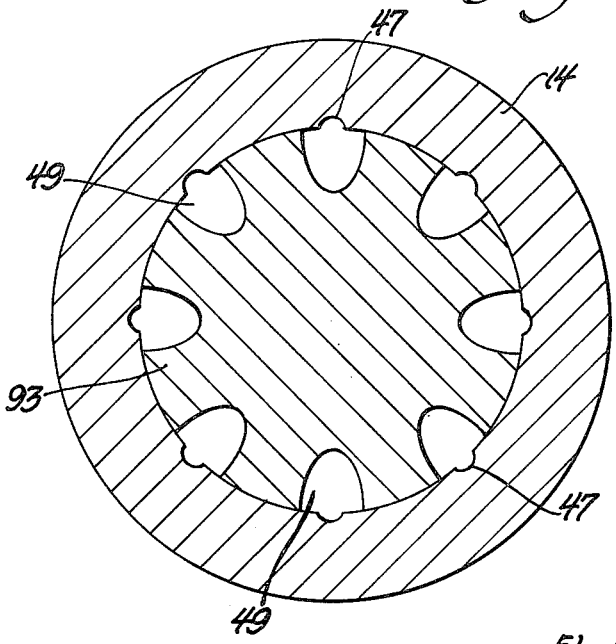
Figure 5:
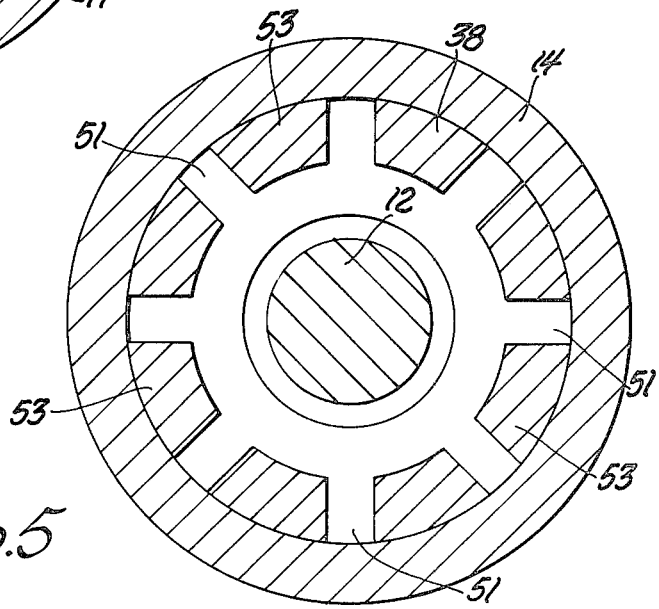

FIGS. 3, 4 and 5 are sectional views taken on lines 3—3, 4—4 and 5—5 in FIG. 1.

Figure 6:
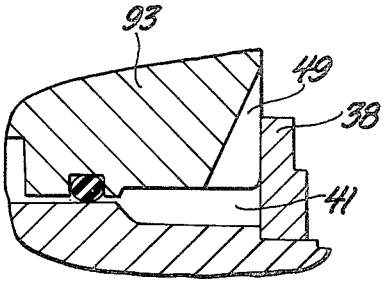
Figure 7:
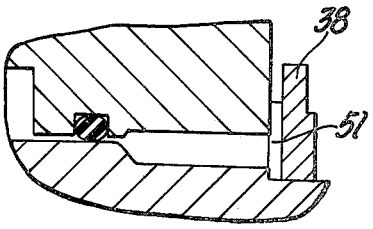

FIGS. 6 and 7 fragmentarily illustrate features of two other embodiments of my invention.

Referring in greater detail to FIG. 1, there is fragmentarily shown a recoil-operated gun generally similar to the gun shown and described in aforementioned U.S. patent applicatin, Ser. No. 909,741. The non-illustrated portionsof the gun can be constructed as shown in U.S. Pat. No.3,512,449 issued in the name of E. M. Stoner. Briefly, the gun mechanism includes a gun barrel 5 mounted in a stationary receiver 24 for recoil movement in the arrow B direction and counter-recoil movement in the arrow A direction. Depending from the barrel is a hollow yoke or block 10 that carries a gas tube 12 closed at its rear end by means of a plug 11.

Tube 12 extends through an annular seal mechanism 32 located within a cup element 40 threaded into a stationary cylinder 14 that is supported on receiver 24. Slidably disposed within cylinder 14 is a impactor piston 93, whose front end surface 95 is normally engaged with a stationary slotted wall element 38 under the biasing force of a compression spring 37. Cup element 40 retains wall element 38 against an internal shoulder within cylinder 14 so that slots 51 in element 38 register with grooves 49 in piston 93. Wall element 38 constitutes an end wall of cylinder 14.

During movement of barrel 5 in the recoil direction (arrow B) gas tube 12 drives piston 93 leftwardly. As the tube moves in the arrow B direction ports 30 in the tube wall communicate with the cylinder space to the left of wall 38, whereupon pressurized combustion gases flow from tube 12 through ports 30 into the cylinder. The gaseous pressure accelerates piston 93 in the recoil direction, thereby causing the piston to operate the bolt carrier (not shown) as described for example in U.S. Pat. No. 3,512,449 issued to E. M. Stoner.

During prolonged gun operation residues or particulates associated with the combustion gases tend to accumulate within cylinder 14. In some cases these residues can coat the piston-cylinder surfaces, causing clogging and bonding to the extent that the gun components fail to reciprocate in the desired fashion. The heated residues appear to bond to the metal surfaces with glue-like action. The present invention is directed to a system of grooves and pockets for removing these residues from the sliding surfaces.

Figure 2:
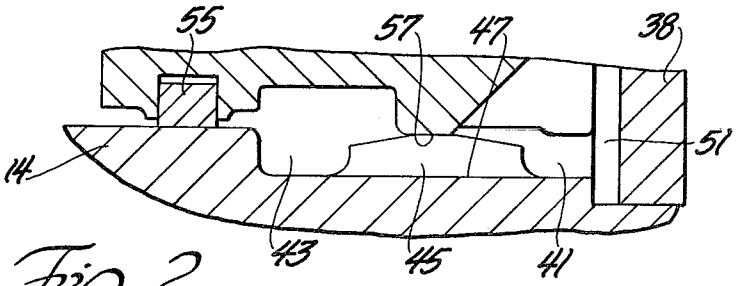
FIG. 2 is a magnified view of a structural configuration employed in the FIG. 1 mechanism.

As shown in FIGS. 1 and 2, the groove-pocket system includes two axially spaced annular pockets 41 and 43 formed in the side surface of cylinder 14. The intervening cylinder wall area 45 is provided with eight slots 47 that communicate one pocket with the other. FIG. 3 illustrates the slot spacing and slot cross-section.

The right end face of piston 93 is provided with eight grooves 49 that communicate the central cylinder space with pocket 41. Additionally eight grooves 51 are formed in the facing surface of stationary end wall 38. The groove 49 orientation is shown in FIG. 4, whereas the groove 51 orientation is shown in FIG. 5. Piston 93 is so positioned or aligned in cylinder 14 that grooves 49 on the piston end surface communicate with grooves 51 in the cylinder end wall. The communicating grooves form passages for carrying residues into pocket 41 as the impactor piston 93 returns toward wall 38. Grooves 49 increase in depth, when measured from the piston axis toward the piston side surface. The relatively large passage depth and passage cross section near the piston side surface tends to slow the gas velocity as it nears pocket 41. The reduced gas velocity increases the probability that entrained particulates will be deposited into pocket 41 rather than rebounding into the joint between the piston end surface and wall 38. As piston 93 passes across wall area 45 toward wall 38 it isolates pocket 43 from pocket 41, except for the connecting slots 47. The relatively small slots accommodate some expansion flow from pocket 41 into pocket 43, thereby decelerating the gas for increased deposition of particulates.

The land areas 53 between grooves 51 (shown in section in FIG. 5) register with the land surfaces on piston end surface 95. Preferably the land areas are sufficient to adequately absorb impact forces without being so large as to form easily-bonded surfaces. In the illustrated structure the annular land areas 53 are approximately seventy percent of the total annular area in registry with the piston end surface; grooves 51 constitute about thirty percent of the total annular area. By keeping the groove area an appreciable percentage of the piston-cylinder end wall interface area it is possible to reduce the land areas where bonding could occur.

In the FIG. 1 mechanism the joint between the piston side surface and cylinder side surface is sealed by a conventional resilient metal sealing ring 55 that is seated in an annular slot in the piston side surface. The sealing ring is located in close proximity to the downstream edge of pocket 43 for wiping residue collections on the cylinder side surface into pocket 43. The enlarged area of the piston includes a land surface 57 that engages the surface of aforementioned wall 45 when the piston is in the FIG. 1 position engaged with cylinder end wall 38; land surface 57 tends to minimize loading on ring 55 as might reduce the sealing action. The side surface areas of the piston are relieved wherever possible to reduce frictional effects and possible bonding due to residue accumulations. Also, the annular surface of wall 45 may be sloped slightly, as shown in FIG. 2, for guidance of the piston.

In the event that pockets 41 and 43 should become filled with particulates the component parts of cylinder 14 may be disassembled for cleanout purposes. However, during normal service many of the particulates will be discharged through one or more ports 15 located in the lower surface of cylinder 14. The port 15 location is selected so that during recoil motion of yoke 10 (arrow B direction) the impactor piston 93 will move to the left of ports 15. As the piston end surface 95 passes leftwardly across port(s) 15 the high pressure gases in the forward end of cylinder 14 are vented to atmosphere through port 15; particulates entrained in the gas are discharged along with the gas. Residues that form during normal service are in relatively loose broken form when received into pockets 41 and 43. Therefore they tend to be automatically reentrained into the high pressure gas for discharge through port(s) 15. There is a lessened tendency for the particulates to be bonded to the piston end surface or cylinder side surface, as would interfere with high speed reciprocatory motion of the piston.

The mechanism shown in FIGS. 1 through 5 represents a preferred embodiment of my invention. Less preferred embodiments are shown in FIGS. 6 and 7. The FIG. 6 mechanism includes a single annular pocket 41 formed in the cylinder side wall between stationary end wall 38 and the sealing surface contacted by ring 55. Gas is delivered to the pocket through eight grooves 49 similar to those used in the FIG. 1 mechanism. The FIG. 7 mechanism is similar to FIG. 6 except that gas is admitted to pocket 41 through eight grooves 51 in stationary end wall 38. The number of grooves used in the various embodiments of my invention may be varied.

I wish it to be understood that I do not desire to be limited to the exact details of construction shown and described for obvious modifications will occur to a person skilled in the art.

I claim:

1. In a recoil-operated gun having a bolt-operating means that includes a gas cylinder, a piston slidably disposed within the cylinder, a gas tube connected with the gun barrel and projecting through an end wall (39) of the cylinder to deliver pressurized combustion gases to an end surface (95) of the piston for moving said piston along the cylinder to operate the bolt, and a sealing means (55) carried by the piston in sliding engagement with the cylinder side wall: the improvement comprising annular pocket means in the cylinder side wall near its juncture with the cylinder end wall; a first set of grooves (49) in the piston end surface, and a second set of grooves (51) in the cylinder end wall; the grooves in each set radiating outwardly from a central portion of the piston-end wall interface, whereby pressurized gases are enabled to flow through the grooves into the annular pocket means; the grooves in the first set communicating with the grooves in the second set when the piston has its end surface engaged with the cylinder end wall; the total area of the grooves being an appreciable percentage of the piston-end wall interface area, to significantly reduce bonding tendencies between the piston end surface and cylinder end wall; the aforementioned annular pocket means having sufficient volumetric capacity to receive and store a significant quantity of residue associated with the combustion gases.

2. The improvement of claim 1: the total area of the grooves being approximately thirty percent of the interface area.

3. The improvement of claim 1: the grooves in the piston end surface gradually increasing in depth measured outwardly from the piston axis to the piston side surface.

4. The improvement of claim 1: the aforementioned annular pocket means comprising two annular pockets in the cylinder side wall; the intervening cylinder wall area between the pockets having a plurality of slots (47) therein communicating one pocket with the other; the piston having a side surface thereof engaged with the intervening cylinder wall area when the piston has its end surface engaged with the cylinder end wall.

* * * * *